US008662009B2

(12) United States Patent
Ando et al.

(10) Patent No.: US 8,662,009 B2
(45) Date of Patent: Mar. 4, 2014

(54) ADHESIVE APPLICATION APPARATUS

(75) Inventors: Takashi Ando, Aikoh-gun (JP); Eijiro Furuta, Aikoh-gun (JP); Akira Honma, Aikoh-gun (JP)

(73) Assignee: NHK Spring Co., Ltd., Kanagawa (JP)

( * ) Notice: Subject to any disclaimer, the term of this patent is extended or adjusted under 35 U.S.C. 154(b) by 453 days.

(21) Appl. No.: 12/881,710

(22) Filed: Sep. 14, 2010

(65) Prior Publication Data

US 2011/0061594 A1 Mar. 17, 2011

(30) Foreign Application Priority Data

Sep. 15, 2009 (JP) ..... P2009-212689

(51) Int. Cl.

| | |
|---|---|
| ***B05C 5/00*** | (2006.01) |
| ***B05D 7/24*** | (2006.01) |
| ***B05D 7/00*** | (2006.01) |
| ***B05D 1/26*** | (2006.01) |
| ***B05D 1/00*** | (2006.01) |

(52) U.S. Cl.

USPC ..... 118/713; 118/712; 118/708

(58) Field of Classification Search

None

See application file for complete search history.

(56) References Cited

U.S. PATENT DOCUMENTS

| | | | | |
|---|---|---|---|---|
| 5,350,600 | A * | 9/1994 | Kubota | 427/256 |
| 5,830,297 | A * | 11/1998 | Nakahira et al. | 156/64 |
| 5,938,871 | A * | 8/1999 | Nakahira et al. | 156/64 |
| 6,082,428 | A * | 7/2000 | Ando et al. | 156/750 |
| 6,089,796 | A * | 7/2000 | Ando et al. | 406/137 |
| 6,494,667 | B1 * | 12/2002 | Suzuki et al. | 414/751.1 |
| 6,754,551 | B1 * | 6/2004 | Zohar et al. | 700/121 |
| 2002/0112821 | A1 * | 8/2002 | Inaba et al. | 156/359 |
| 2003/0008412 | A1 * | 1/2003 | Coffman et al. | 436/180 |
| 2004/0259168 | A1 * | 12/2004 | Kopaciewicz et al. | 435/7.1 |
| 2005/0001869 | A1 * | 1/2005 | Abernathy et al. | 347/17 |
| 2005/0051471 | A1 * | 3/2005 | Lane et al. | 210/321.6 |
| 2007/0134969 | A1 | 6/2007 | Endo et al. | |
| 2011/0045167 | A1 * | 2/2011 | Ikushima | 427/8 |

FOREIGN PATENT DOCUMENTS

| | | | | |
|---|---|---|---|---|
| JP | 8-224522 | | 9/1996 | |
| JP | 9-075830 | | 3/1997 | |
| JP | 09-075830 | * | 3/1997 | B05C 21/00 |
| JP | 11-097484 | * | 4/1999 | H01L 21/60 |
| JP | 2007-176152 | | 7/2007 | |
| JP | 2008-168526 | | 7/2008 | |

* cited by examiner

*Primary Examiner* — Dah-Wei Yuan
*Assistant Examiner* — Jethro Pence
(74) *Attorney, Agent, or Firm* — Jordan and Hamburg LLP

(57) ABSTRACT

An adhesive application apparatus for applying a liquid adhesive to an object includes a regular application stage against which the object is placed for a regular application of the liquid adhesive to the object, a trial application stage to which a trial application of the liquid adhesive is carried out, an application unit relatively movable with respect to the regular application stage and trial application stage to carry out the regular application and trial application of the liquid adhesive, and a suction unit carrying out a suction operation of the liquid adhesive used in the trial application. The adhesive application apparatus smoothly carries out the trial application of the liquid adhesive without bothering the operation of an adhesive application line.

8 Claims, 8 Drawing Sheets

Just after trial application
(without repellence)

Just after suction operation

Just after trial application
(with repellence)

ADHESIVE APPLICATION APPARATUS

BACKGROUND OF THE INVENTION

1. Field of the Invention

The present invention relates to an adhesive application apparatus for applying a liquid adhesive to an object, and particularly, to an adhesive application apparatus capable of smoothly achieving a trial application of a liquid adhesive without bothering the operation of an adhesive application line.

2. Description of Related Art

Before a regular application of a liquid adhesive to an object, it is usual to carry out a trial application of the liquid adhesive. Techniques related to such a trial application are disclosed in, for example, Japanese Unexamined Patent Application Publications No. H09-75830 (JP 09-75830 A) and No. H11-97484 (JP 11-97484 A).

According to the related art of JP 09-75830 A, an adhesive application apparatus employs, for a trial application of an adhesive, a feed reel around which a trial application tape is wound and a take-up reel to take up the trial application tape. A part of the trial application tape between the feed reel and the take-up reel is supported with a support table. A trial adhesive is applied to the part of the trial application tape supported with the support table. After the trial, the part of the trial application tape where the trial adhesive has been applied is taken up by the take-up reel. This related art may easily carry out a trial application of an adhesive.

The related art, however, has a drawback of causing slack in the trial application tape. If the trial application tape slackens, the tape may get entangled with peripheral parts, to hinder the taking-up operation of the tape. If the entanglement happens, an adhesive application line must temporarily be suspended for a removal of the tape.

SUMMARY OF THE INVENTION

An object of the present invention is to provide an adhesive application apparatus capable of smoothly carrying out a trial application of a liquid adhesive without bothering the operation of an adhesive application line.

In order to accomplish the object, an aspect of the present invention provides an adhesive application apparatus for applying a liquid adhesive to an object, including a regular application stage against which the object is placed for a regular application of the liquid adhesive to the object, a trial application stage to which a trial application of the liquid adhesive is carried out, an application unit relatively movable with respect to the regular application stage and trial application stage to carry out the regular application and trial application of the liquid adhesive, and a suction unit carrying out a suction operation of the liquid adhesive used in the trial application.

According to this aspect of the present invention, the adhesive application apparatus employs the suction unit to conduct a suction operation of the liquid adhesive applied in the trial application, and therefore, can smoothly achieve the trial application of the liquid adhesive without bothering the operation of an adhesive application line.

BRIEF DESCRIPTION OF THE DRAWINGS

FIGS. 3A to 3C are explanatory views illustrating an applied adhesive, an adsorptive pad, and a suction device in the apparatus of FIG. 1A, in which FIG. 3A is of just after trial application without repellence, FIG. 3B is of just after suction operation, and FIG. 3C is of just after trial application with repellence;

DETAILED DESCRIPTION OF EMBODIMENTS

An adhesive application apparatus according to an embodiment of the present invention will be explained in detail with reference to the drawings. The adhesive application apparatus employs a suction unit to conduct a suction operation of a liquid adhesive applied on a trial application stage, to smoothly achieve a trial application of the liquid adhesive without bothering the operation of an adhesive application line.

Figure 1A:
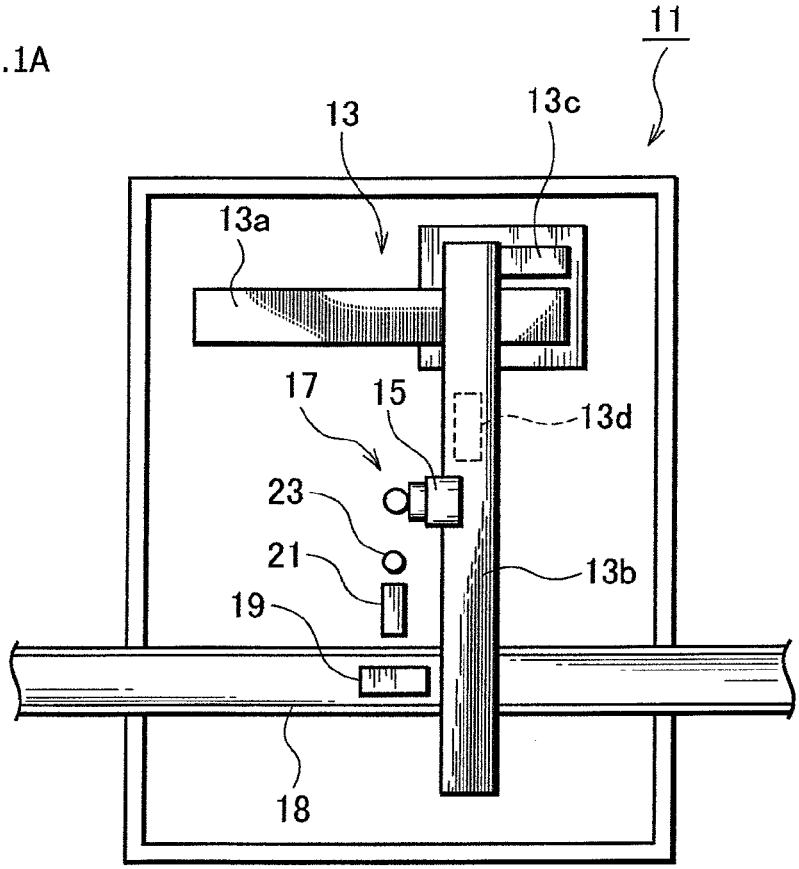
FIG. 1A is a plan view generally illustrating an adhesive application apparatus according to an embodiment of the present invention.
Figure 1B:
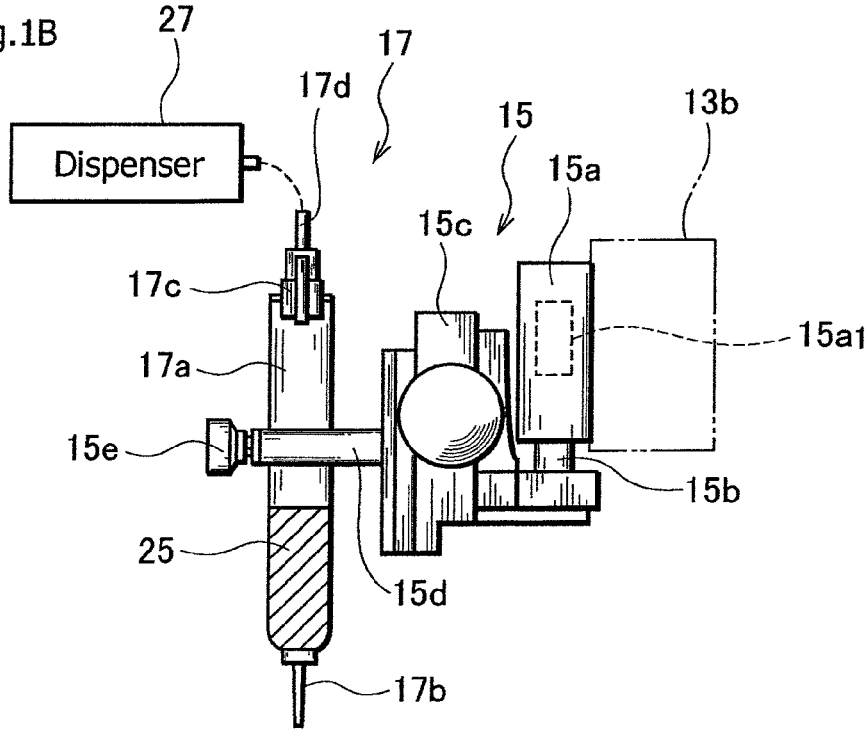
FIG. 1B is a side view illustrating an adhesive application head of the apparatus illustrated in FIG. 1A.
Figure 2:
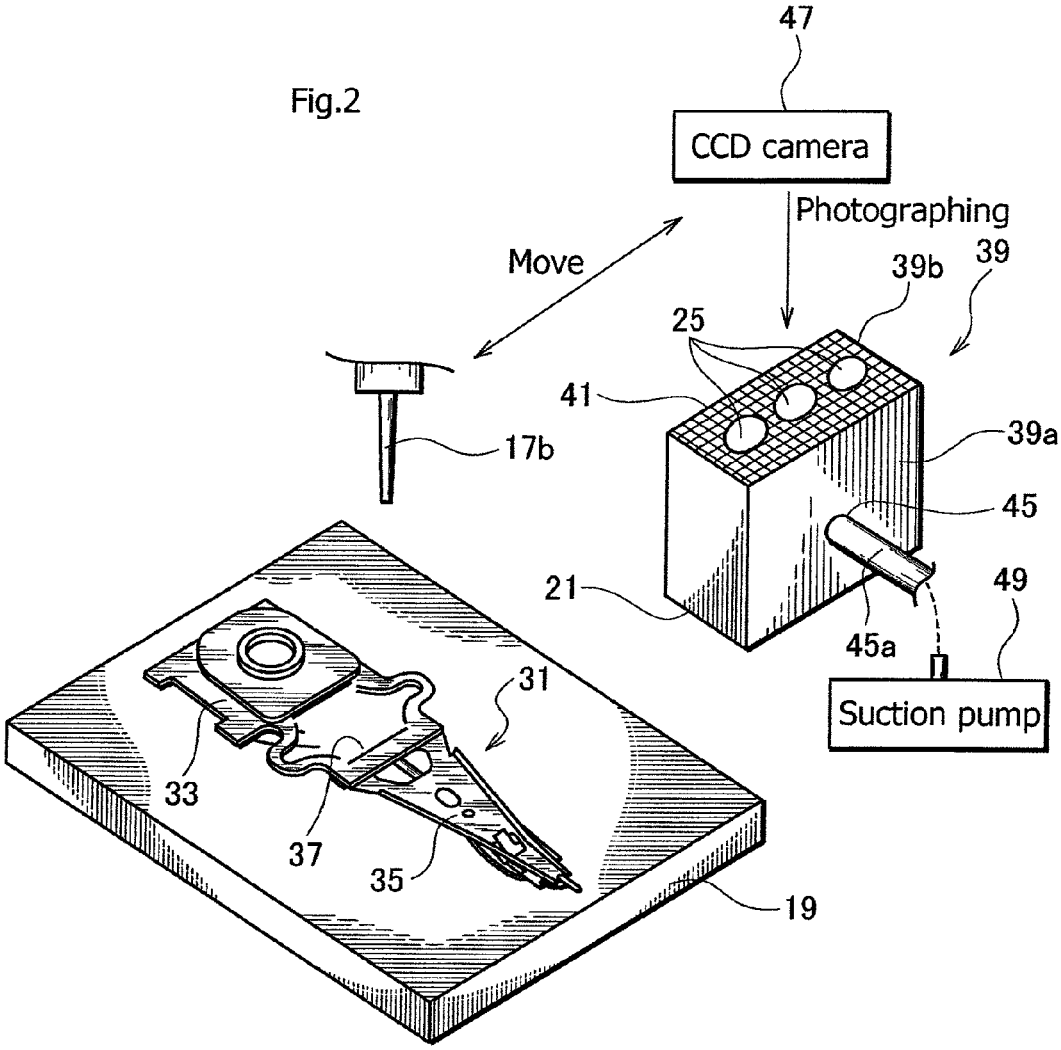
FIG. 2 is a perspective view illustrating a regular application stage and a trial application stage of the apparatus illustrated in FIG. 1A.
Figures 3A, 3B, 3C:
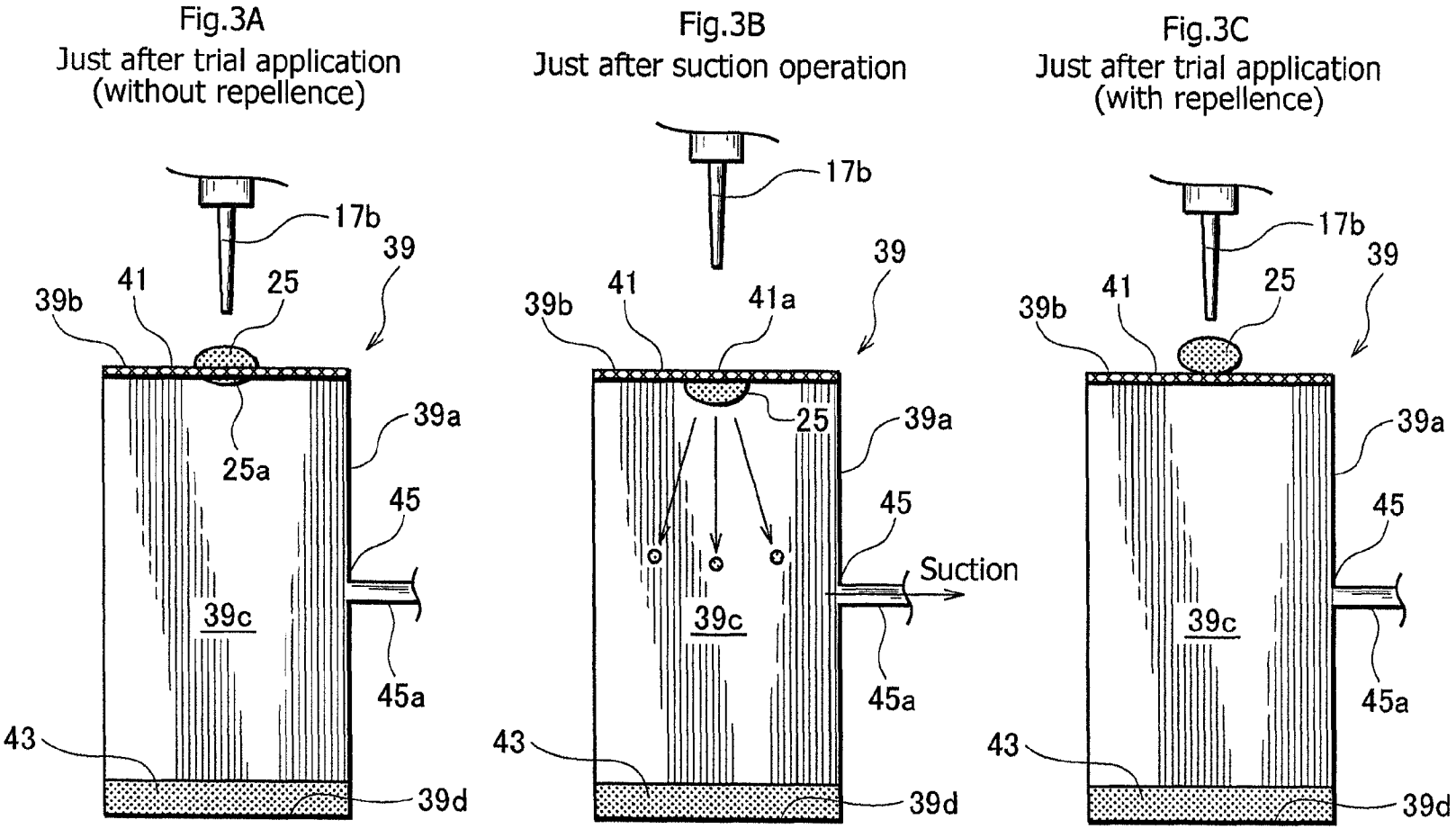

FIG. 1A is a plan view generally illustrating the adhesive application apparatus according to the embodiment, FIG. 1B is a side view illustrating an adhesive application head of the apparatus, FIG. 2 is a perspective view illustrating a regular application stage and a trial application stage of the apparatus, and FIGS. 3A to 3C are explanatory views illustrating applied adhesive droplets, an adsorptive pad, and a suction device in the apparatus.

In FIGS. 1A and 1B, the adhesive application apparatus 11 according to the embodiment includes an X-Y arm mechanism 13, a Z-axis drive mechanism 15, an adhesive application head 17, a conveyor 18 for conveying an object to which an adhesive is applied, a regular application stage 19, a trial application stage 21, and a touch sensor 23.

The X-Y arm mechanism 13 has an X-axis arm 13*a*, a Y-axis arm 13*b*, an X-axis motor 13*c*, and a Y-axis motor 13*d*.

The X-axis arm 13*a* and Y-axis arm 13*b* are orthogonal to each other. The X-axis motor 13*c* drives the Y-axis arm 13*b* along the X-axis arm 13*a*. The Y-axis motor 13*d* drives the Z-axis drive mechanism 15 along the Y-axis arm 13*b*.

In the X-Y arm mechanism 13, drive circuits 61*a* and 61*b* (to be explained later) receive drive signals from a control unit 51 (to be explained later) and drive the X-axis motor 13*c* and Y-axis motor 13*d*, to move the adhesive application head 17 to a specified position on X- and Y-axes.

The Z-axis drive mechanism 15 has a base 15*a* adjacent to the Y-axis arm 13*b*, a rod 15*b*, an intermediate support 15*c*, a rod 15*d*, and a stopper 15*e*. The base 15*a* is movably supported by the Y-axis arm 13*b* and is provided with a Z-axis motor 15*a*1 to move the rod 15*b* along the Z-axis. The rod 15*b* transfers the motion of the Z-axis motor 15*a*1 to the intermediate support 15*c* and rod 15*d*.

In response to a drive signal from the control unit 51, a drive circuit 61*c* (to be explained later) drives the Z-axis motor 15*a*1, to move the adhesive application head 17 to a specified position on the Z-axis.

The adhesive application head 17 is relatively movable with respect to the regular application stage 19 and trial application stage 21, to carry out a regular application of an adhesive 25 and a trial application of the same. The adhesive application head 17 has a cylindrical syringe 17*a*, a nozzle 17*b* at a lower end of the syringe 17*a*, a lid 17*c* at an upper end of the syringe 17*a*, and a tube 17*d* connected to a dispenser 27. The adhesive application head 17 is vertically oriented along the Z-axis and is fixed to the rod 15*d* of the Z-axis drive mechanism 15 with the stopper 15*e* on a front end of the rod 15*d*.

The syringe 17*a* contains the adhesive 25 to be applied to the object. The adhesive 25 is discharged from a front end of the nozzle 17*b* with compressed air sent from the dispenser 27 into the syringe 17*a*. The adhesive 25 is selected from appropriate adhesives including a thermosetting adhesive and an ultraviolet curing adhesive.

The tube 17*d* is connected to the lid 17*c* and dispenser 27, to feed compressed air from the dispenser 27 into the syringe 17*a*.

The regular application stage 19 is a place against which the object is placed for applying the adhesive 25 to the object and is arranged on the conveyor 18, as illustrated in FIGS. 1A and 2. The trial application stage 21 is a place to which a trial application of the adhesive 25 is carried out and is arranged in the vicinity of the conveyor 18.

The touch sensor 23 is used to determine an origin position of the adhesive application head 17 on the Z-axis.

The adhesive application head 17 and dispenser 27 serves as an application unit relatively movable with respect to the regular application stage 19 and trial application stage 21 to carry out the regular application and trial application of the adhesive 25.

According to the embodiment, the object is a half-finished head suspension 31 and is placed on the regular application stage 19, as illustrated in FIG. 2.

After finished, the head suspension 31 is installed in, for example, a magnetic disk drive (not illustrated) to write/read data to and from a magnetic disk and includes a base plate 33, a load beam 35, a magnetic head slider (not illustrated) resiliently supported with the load beam 35, and the like. The base plate 33 supports a piezoelectric element (not illustrated) that deforms in response to a voltage applied thereto. The load beam 35 is resiliently supported with the base plate 33.

The base plate 33 of the half-finished head suspension 31 has an opening 37. To a peripheral edge of the opening 37, the adhesive 25 discharged from the adhesive application head 17 is applied to attach the piezoelectric element to the opening 37. With this, the half-finished head suspension 31 becomes a finished product having a function of minutely moving a front end of the load beam 35 in a sway direction (a widthwise direction of the head suspension) in response to a deformation of the piezoelectric element.

The trial application stage 21 includes an adhesive suction device 39 having a suction pump 49 is connected to the trial application stage 21 to draw the adhesive 25 applied for a trial. The suction device 39 has a rectangular parallelepiped casing 39*a* having an open top 39*b*, an adsorptive pad 41 covering the open top 39*b*, a liquid trap 43, and a suction port 45.

The adsorptive pad 41 illustrated in FIGS. 2 and 3A to 3C is a part on which the adhesive 25 is applied for a trial. Namely, the adsorptive pad 41 has a surface on which the adhesive 25 is applied in the trial application. The adsorptive pad 41 is porous so that the adhesive 25 applied thereto stays thereat before a suction operation and passes therethrough in the suction operation.

The adsorptive pad 41 is preferably a mesh sheet made of synthetic resin such as nylon (registered trade mark of Du Pont). The material, weaving method, and mesh size of the mesh sheet are properly selected in consideration of the material of the adhesive 25, the size of a droplet of the adhesive 25, and the like.

The whole of the mesh sheet or at least a trial application area 41*a* thereof where the adhesive 25 is applied is preferably coated with, for example, fluorine to realize liquid repellence, so that it prevents the adhesive 25 from penetrating the mesh sheet of the adsorptive pad 41. This is because a trial droplet of the adhesive 25 put on the pad 41 is preferable to have a neat ball shape as illustrated in FIG. 3C, so that the adhesive droplet is correctly examined to determine whether or not the quantity of the droplet is adequate.

In FIG. 2, a CCD camera 47 is arranged at an upper oblique position of the adsorptive pad 41, to pick up an image (trial application image) of a trial droplet of the adhesive 25 applied to the pad 41. The location of the CCD camera 47 is determined not to interfere with the operation of the adhesive application head 17.

As illustrated in FIGS. 3A to 3C, the liquid trap 43 is defined at a bottom 39*d* of an inner space 39*c* of the casing 39*a*, to keep the adhesive 25 passed through the adsorptive pad 41.

The suction port 45 guides air from the inner space 39*c* of the casing 39*a* to the outside. The suction port 45 is arranged substantially at the center of a side wall of the casing 39*a*. The suction port 45 is spaced away from the bottom 39*d* of the casing 39*a*, to avoid droplets of the adhesive 25 falling from the adsorptive pad 41 due to a suction operation from being drawn into the suction port 45. The suction port 45 is connected to a tube 45*a* that is connected to the suction pump 49 to draw droplets of the adhesive 25 falling from the pad 41. The suction pump 49 serves as a suction unit.

Figure 4:
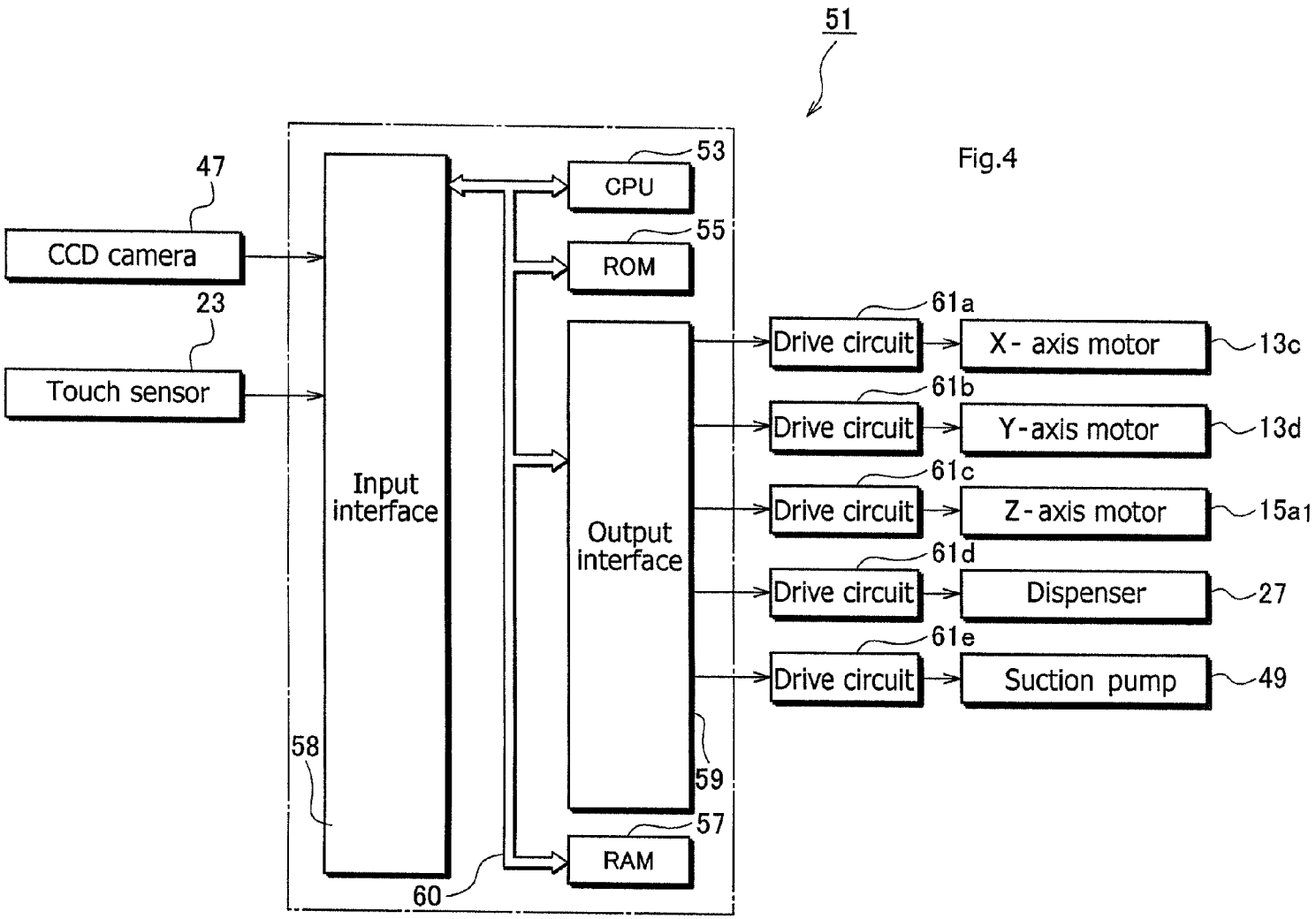
FIG. 4 is a block diagram illustrating a control unit of the apparatus of FIG. 1A.

A general structure of the control unit 51 of the adhesive application apparatus 11 according to the embodiment will be explained with reference to a block diagram illustrated in FIG. 4.

The control unit 51 is substantially a computer having a CPU 53, a ROM 55, a RAM 57, an input interface 58, an output interface 59, and a bus 60 to connect these components to one another.

The ROM 55 stores various programs such as a program to apply the adhesive 25 to an object, a program to correct a positional error of the nozzle 17*b*, a program to determine whether the quantity and shape of an applied portion of the adhesive 25 is appropriate, and a program to conduct a trial application of the adhesive 25.

The RAM 57 is a main memory of the computer and temporarily stores various kinds of data.

The input interface 58 converts input data into data processible by the CPU 53. The input interface 58 is connected to the CCD camera 47 and touch sensor 23.

The output interface 59 converts internal data into output data processible by external devices. The output interface 59 is connected to drive circuits 61*a* to 61*e* that are connected to the X-axis motor 13*c*, Y-axis motor 13*d*, Z-axis motor 15*a*1, dispenser 27, and suction pump 49, respectively.

Figure 5:
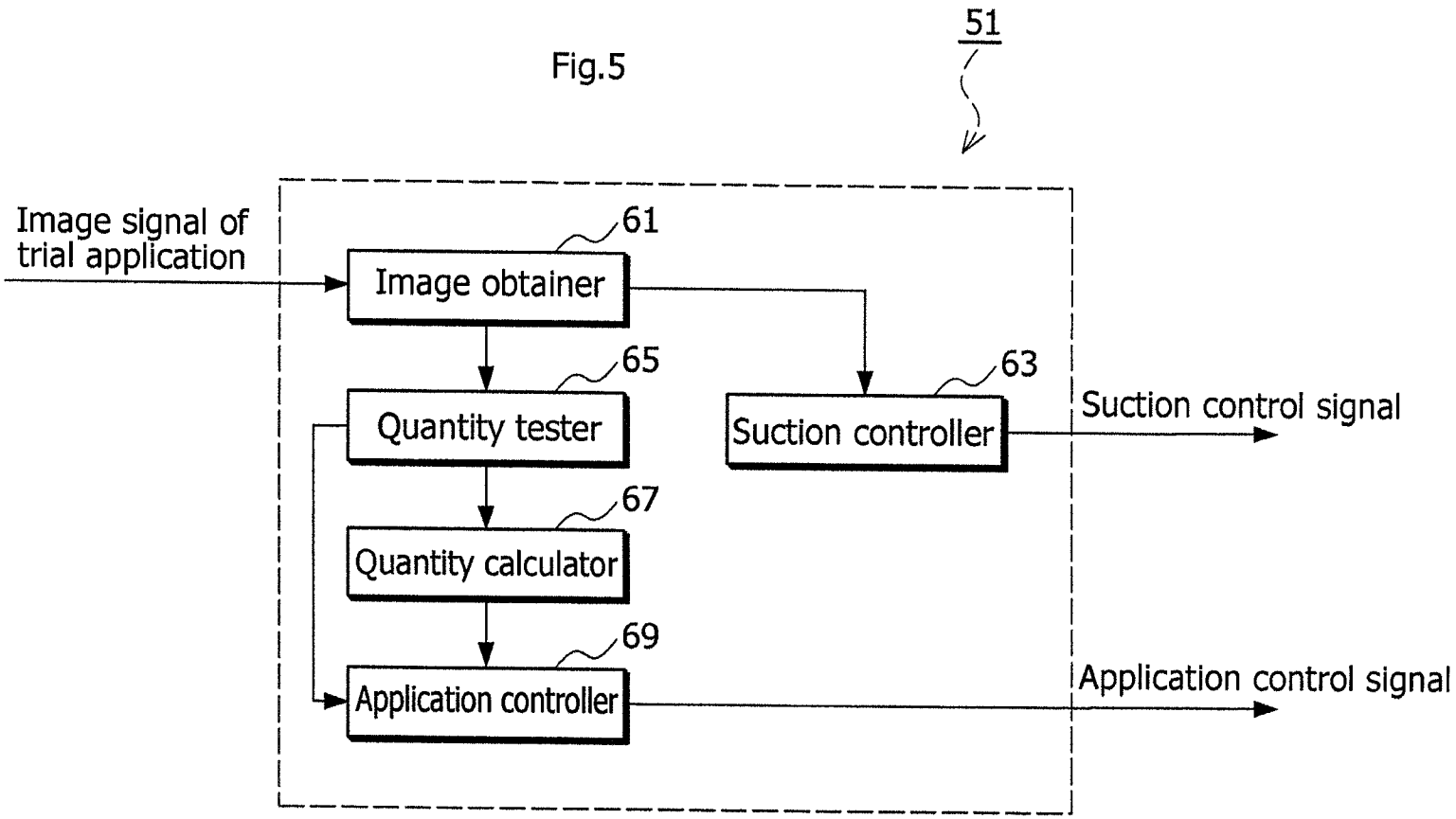
FIG. 5 is a functional block diagram illustrating the control unit of FIG. 4.

A functional arrangement related to an adhesive trial application of the control unit 51 of the adhesive application apparatus 11 according to the embodiment will be explained with reference to a block diagram illustrated in FIG. 5. In FIG. 5, the control unit 51 includes an image obtainer 61, a suction controller 63, a quantity tester 65, a quantity calculator 67, and an application controller 69.

The image obtainer 61 obtains from the CCD camera 47 an image of a trial droplet of the adhesive 25 applied to the trial application stage 21. Image obtained information indicating that the image obtainer 61 has obtained the image is sent to the suction controller 63.

The suction controller 63 configured to make the suction pump 49 carry out the suction operation of the applied adhesive 25 at or after a time when the image obtainer 61 obtains the image of the applied adhesive 25. Namely, at or after the time when the image obtainer 61 obtains the image of the trial adhesive droplet based on the image obtained information from the image obtainer 61, the suction controller 63 issues a suction control signal to make the suction pump 49 draw the applied adhesive droplet from the trial application stage 21. Preferably, at the time when obtaining the image, the suction controller 63 issues the suction control signal.

Based on the image of the adhesive droplet obtained by the image obtainer 61 and a predetermined reference quantity of the adhesive 25, the quantity tester 65 determines whether or not the quantity of the applied adhesive droplet is appropriate.

More precisely, the quantity tester 65 processes the image of the adhesive droplet and measures the area of the droplet. This area is considered to represent the quantity of the applied adhesive. If the measured area is within a predetermined range between upper and lower limits for a required quantity of the adhesive 25, the quantity tester 65 determines that the quantity of the applied adhesive is appropriate, and if the measured area is out of the predetermined range, determines that it is inappropriate.

If the quantity tester 65 determines that the quantity of the applied adhesive is inappropriate, the quantity calculator 67 calculates, according to data related to the determination made by the quantity tester 65, a correction amount of the adhesive 25 to be applied.

More precisely, the quantity calculator 67 calculates a correction quantity of the adhesive 25 to be applied according to a relationship between the area that has been determined to be inappropriate and the predetermined range. The quantity calculator 67 finds a quantity of the adhesive 25 to be applied on the basis of the area and correction quantity.

Based on the quantity found by the quantity calculator 67, the application controller 69 instructs the adhesive application head 17 to carry out an application of the adhesive 25.

More precisely, the application controller 69 sets various parameters including a time and pressure of compressed air to be supplied from the dispenser 27 as a conditions to realize the quantity of the adhesive 25 found by the quantity calculator 67. The application controller 69 issues an application control signal representing the set conditions, to carry out a regular or trial application of the adhesive 25 with the use of the dispenser 27 and adhesive application head 17.

Operation of the control unit 51 will be explained with reference to a flowchart illustrated in FIG. 6.

Step S11 is a trial application step. The control unit 51 issues a trial application control signal, and according to the signal, the adhesive application head 17 moves onto the trial application stage 21 and carries out a trial application of the adhesive 25 based on predetermined trial application conditions.

In FIG. 3A, the trial application step applies a droplet of the adhesive 25 on the adsorptive pad 41. The size of the droplet is dependent on the kind of the object and is about 0.03 to 1.50 mm according to the embodiment.

In FIG. 3A, the trial application area 41*a* of the adsorptive pad 41 has no repellence, and therefore, the adhesive droplet slightly passes through the pad 41 to form an ooze 25*a* on the backside of the pad 41 opposite to the surface side on which the adhesive 25 applied in the trial application.

In FIG. 3C, the trial application area 41*a* of the adsorptive pad 41 has repellence, and therefore, the adhesive droplet stays on the pad 41 and keeps a neat ball shape. The neat ball shape of the adhesive droplet improves accuracy when determining whether or not the quantity of the adhesive droplet is appropriate based on an image of the adhesive droplet.

Step S12 is an image obtain step. The image obtainer 61 obtains from the CCD camera 47 an image of the droplet of the adhesive 25 applied to the trial application stage 21. The obtained image is stored in a predetermined space in the RAM 57 and is used in step S14 and later steps.

Step S13 is a suction step. The suction controller 63 of the control unit 51 outputs a suction control signal, and based on the signal, the suction pump 49 connected to the adhesive suction device 39 draws the adhesive droplet applied in step S11. This produces a negative pressure in the inner space 39*c*, so that the adhesive droplet passes through the adsorptive pad 41 to the backside thereof. Thereafter, the droplet falls as one piece or as smaller droplets 25*b* into the liquid trap 43 as illustrated in FIG. 3B. In this way, the droplet of the adhesive 25 is cleared from the pad 41 and the trial application area 41*a* of the pad 41 restores a clean state.

Step S14 is a determination step. The quantity tester 65 processes the image of the droplet of the adhesive 25 and measures an area of the droplet. If the area is within the predetermined range, the quantity tester 65 determines that the quantity of the droplet is appropriate, and if it is out of the range, determines that the droplet quantity is inappropriate.

Step S15 is a branching step carried out according to a result of step S14. If step S14 determines that the droplet quantity is inappropriate, the control unit 51 advances to step S16.

Step S16 is a calculation step. The quantity calculator 67 calculates a correction quantity of the adhesive 25 based on a relationship between the droplet area determined to be inappropriate and the predetermined range, and according to the correction quantity and area, finds a quantity of the adhesive 25 to be applied.

After step S16, the control unit 51 returns to step S11 and sequentially carries out the steps that follow. For example, step S11 carried out after step S16 employs the quantity of the adhesive 25 found in step S16 and carries out the trial application operation.

If step S14 determines that the droplet quantity is appropriate, the control unit 51 advances to step S17.

Step S17 is a regular application step. The regular application stage 19 on which the half-finished head suspension 31 is placed is carried on the conveyor 18. The application controller 69 sets various parameters including a time and pressure of compressed air to be supplied from the dispenser 27 as a condition to realize the quantity of the adhesive 25 found by the quantity calculator 67 and issues an application control signal representing the set conditions. According to the signal, the dispenser 27 and adhesive application head 17 carry out a regular application of the adhesive 25 to the head suspension 31.

In consequence, the embodiment can apply a droplet of the adhesive 25 in a specified quantity to a spot on an object, such as a spot on a circumferential edge of the opening 37 of the half-finished head suspension 31.

In this way, the adhesive application apparatus 11 according to the embodiment employs the trial application stage 21 provided with the suction pump 49 as the suction unit to smoothly conduct a suction operation of the adhesive 25 applied to the trial application stage 21 without bothering the operation of an adhesive application line.

The adhesive suction device 39 provided for the trial application stage 21 has the porous adsorptive pad 41 that keeps thereon a trial droplet of the adhesive 25 before the suction operation is carried out and passes the droplet therethrough in the suction operation. It can surely realize the smooth suction operation of the adhesive 25.

The trial application area 41*a* of the adsorptive pad 41 is provided with repellency so that a droplet of the adhesive 25 applied to the trial application area 41*a* keeps a neat ball shape and stays thereat without passing through the pad 41. The neat ball shape of the adhesive droplet improves accuracy when determining whether or not the quantity of the droplet is appropriate based on an image of the droplet.

The adhesive suction device 39 provided for the trial application stage 21 has the liquid trap 43 to completely receive the adhesive 25 passed through the adsorptive pad 41 into the inner space 39*c* and keep the adhesive 25 therein.

The control unit 51 of the adhesive application apparatus 11 according to the embodiment has the image obtainer 61 to obtain an image of a droplet of the adhesive 25 applied to the trial application stage 21 and the suction controller 63 to make the suction pump 49 draw the adhesive droplet at or after the time when the image obtainer 61 obtains the image of the droplet.

If the adhesive suction operation is carried out before the image of the adhesive droplet is obtained, it will be impossible to determine whether or not the quantity of the adhesive droplet is appropriate. The control unit 51 of the embodiment causes no such a problem and is capable of carrying out the suction operation at proper timing without bothering the determination whether or not the quantity of the adhesive droplet is appropriate.

Next, a control unit 71 according to a modification of the embodiment will be explained with reference to FIG. 7.

Figure 7:
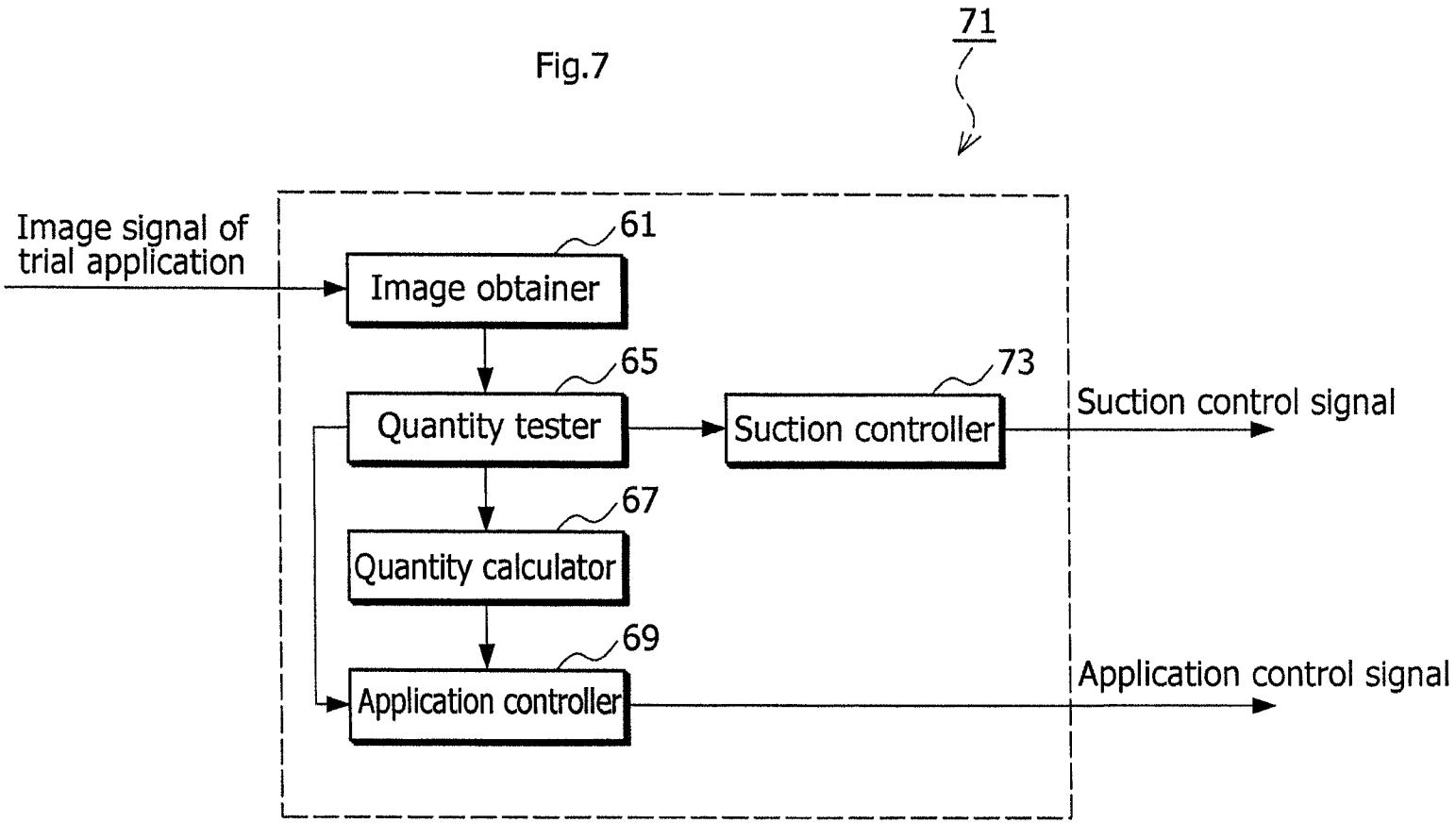
FIG. 7 is a functional block diagram illustrating a control unit according to a modification of the embodiment of FIG. 5.

A functional arrangement of the control unit 71 according to the modification illustrated in FIG. 7 is the same as that of the control unit 51 of the embodiment illustrated in FIG. 5. Accordingly, a characteristic part of the modification will mainly be explained.

According to the control unit 51 of FIG. 5, the suction controller 63 carries out a suction operation at or after the time when the image obtainer 61 obtains an image of a droplet of the adhesive 25 applied to the trial application stage 21.

According to the control unit 71 of FIG. 7, a suction controller 73 carries out a suction operation when a quantity tester 65 determines that the quantity of a droplet of the adhesive 25 applied to the trial application stage 21 is appropriate.

Namely, the control unit 71 according to the modification employs a different trigger event from that of the control unit 51 of FIG. 5, to start the suction operation.

The control unit 71 of FIG. 7 has an image obtainer 61, the quantity tester 65, a quantity calculator 67, an application controller 69, and the suction controller 73.

The suction controller 73 that is a characteristic part of the modification causes the suction pump 49 as the suction unit to carry out a suction operation of the adhesive 25 applied to the trial application stage 21 if the quantity tester 65 determines that the quantity of the applied adhesive is appropriate. Namely, at the time when the quantity tester 65 determines that the quantity of the applied adhesive is appropriate, the suction controller 73 issues a suction control signal to make the suction pump 49 carry out the suction operation of the applied adhesive.

Figure 8:
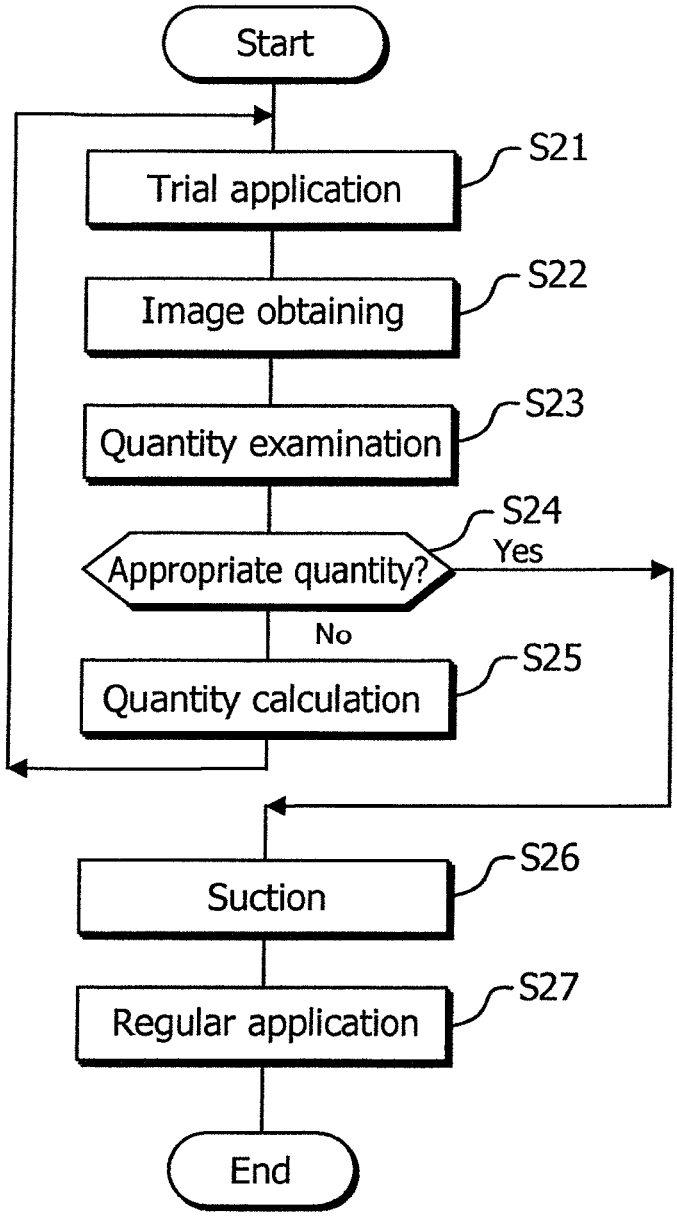
FIG. 8 is a flowchart illustrating operation of the control unit of FIG. 7.

Operation of the control unit 71 according to the modification will be explained with reference to a flowchart illustrated in FIG. 8.

Step S21 is a trial application step. The control unit 71 issues a trial application control signal, and according to the signal, the adhesive application head 17 moves to the trial application stage 21 and carries out a trial application of the adhesive 25 based on predetermined trial application conditions.

Step S22 is an image obtain step. The image obtainer 61 obtains from the CCD camera 47 an image of a trial droplet of the adhesive 25 applied to the trial application stage 21.

Step S23 is a determination step. The quantity tester 65 processes the image of the droplet of the adhesive 25 and measures an area of the droplet. If the area is within a predetermined range, the quantity tester 65 determines that the quantity of the droplet is appropriate, and if it is out of the range, determines that the droplet quantity is inappropriate.

Step S24 is a branching step carried out according to a result of step S23. If step S23 determines that the droplet quantity is inappropriate, the control unit 71 advances to step S25.

Step S25 is a calculation step. The quantity calculator 67 calculates a correction quantity of the adhesive 25 based on a relationship between the droplet area determined to be inappropriate and the predetermined range, and according to the correction quantity and area, finds a quantity of the adhesive 25 to be applied.

After step S25, the control unit 71 returns to step S21 and sequentially carries out the steps that follow. For example, step S21 carried out after step S25 employs the quantity of the adhesive 25 found in step S25 and carries out the trial application operation.

If step S24 determines that the droplet quantity is appropriate, the control unit 71 advances to step S26.

Step S26 is a suction step. The suction controller 73 of the control unit 71 outputs a suction control signal, and based on the signal, the suction pump 49 draws the adhesive droplet applied in step S21.

Figure 6:
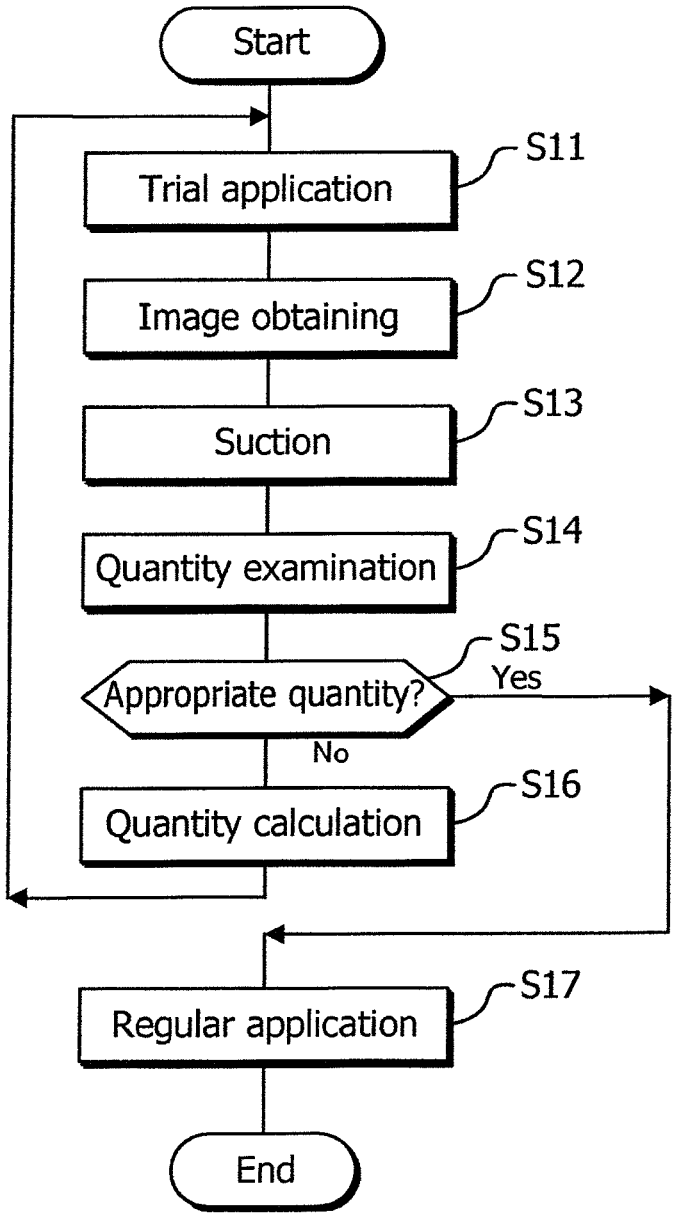
FIG. 6 is a flowchart illustrating operation of the control unit of FIGS. 4 and 5.

Step S27 is similar to step S17 of FIG. 6 and carries out a regular application of the adhesive 25 to an object such as the half-finished head suspension 31.

As explained above, the control unit 71 according to the modification employs the image obtainer 61 to obtain an image of a trial droplet of the adhesive 25 applied to the trial application stage 21, the quantity tester 65 to determine whether or not the quantity of the applied adhesive droplet is appropriate based on the image of the droplet obtained by the image obtainer 61 and a predetermined reference quantity of the adhesive 25, and the suction controller 73 to instruct the suction pump 49 to draw the adhesive droplet if the quantity tester 65 determines that the quantity of the droplet is appropriate.

In addition, the control unit 71 of the modification employs the quantity calculator 67 to calculate, if the quantity tester 65 determines that the quantity of the applied adhesive droplet is inappropriate, a quantity of the adhesive 25 to be applied according to data related to the determination made by the quantity tester 65 and the application controller 69 to instruct the adhesive application head 17 to carry out a trial application of the adhesive 25 based on the quantity calculated by the quantity calculator 67.

The modification assumes that a plurality of trial droplets of the adhesive 25 are successively formed at different spots in the trial application area 41*a* of the absorptive pad 41. At a time when the quantity tester 65 determines that the quantity of the just applied adhesive droplet is appropriate, the control unit 71 instructs the suction pump 49 to carry out a suction operation to simultaneously draw and clear all adhesive droplets from the pad 41.

If the number of droplets of the adhesive 25 successively applied to the absorptive pad 41 exceeds an allowable number, the control unit 71 makes the suction pump 49 draw all of the droplets at that moment.

Compared with the embodiment that carries out a suction operation whenever an image of a trial droplet of the adhesive 25 is picked up, the modification reduces the number of suction operations and optimizes the trial application of the adhesive. Also, the modification can find an optimum quantity of a droplet of the adhesive 25 through comparison of the images of a plurality of trial droplets of the adhesive 25, thereby saving a time for optimizing a quantity of the adhesive 25 to be applied.

The present invention is not limited to the above-mentioned embodiment and modification. The embodiment and modification of the present invention mentioned above allow other various modifications without departing from the gist and technical ideas of the present invention suggested in the specification and claims. Any such modification falls in the scope of the present invention.

Although the embodiment adopts a half-finished head suspension as an object to which an adhesive is applied, the present invention is widely applicable to any object that allows a liquid adhesive to be applied thereto.

Although the embodiment adopts a thermosetting adhesive or an ultraviolet curing adhesive, the present invention can adopt any liquid adhesive.

Although the embodiment determines whether or not the quantity of a trial adhesive droplet is appropriate according to an area of the droplet, the present invention can employ any other data related to the droplet when making the determination. For example, the present invention may obtain, from an image of the droplet, the outer diameter, height, or thickness of the droplet, or any combination thereof, and according to the data, determine whether or not the quantity of the droplet is appropriate.

Although the embodiment examines every adhesive droplet applied to the trial application stage 21, the present invention may discard the first droplet or a predetermined number of droplets at the start of a trial, and thereafter, examine every adhesive droplet.

Although the embodiment connects the suction pump 49 to a central part of a side face on the backside of the adsorption pad 41 and draws an adhesive droplet applied to the surface of the adsorption pad 41, the present invention may arrange a suction mechanism movable over the pad 41 and draw from the surface side of the pad 41 an adhesive droplet applied to the surface of the pad 41.

What is claimed is:

1. An adhesive application apparatus for applying a liquid adhesive to an object, comprising:

a regular application stage against which the object is placed for a regular application of the liquid adhesive to the object;

a trial application stage to which a trial application of the liquid adhesive is carried out;

an application unit relatively movable with respect to the regular application stage and trial application stage to carry out the regular application and trial application of the liquid adhesive;

a suction unit carrying out a suction operation of the liquid adhesive used in the trial application; and a porous adsorptive pad provided with the trial application stage and including a porous liquid-repellant part comprising a fluorine coating and a porous non-liquid-repellant part, wherein the non-liquid-repellant part is constructed so as to allow a droplet of the liquid adhesive to pass through from a front side to a backside of the non-liquid-repellant part even in absence of the suction operation, and wherein the liquid-repellant part comprising the fluorine coating is constructed so as to not pass the droplet of the liquid adhesive from a front side through to a backside of the liquid-repellant part comprising the fluorine coating until the suction operation is performed.

2. The adhesive application apparatus of claim 1, wherein the suction unit is connected to a back side of the porous adsorptive pad opposite to a surface side thereof on which the liquid adhesive is applied in the trial application.

3. The adhesive application apparatus of claim 1, wherein:

a liquid trap provided with the trial application stage and to keep the liquid adhesive passed through the porous adsorptive pad.

4. The adhesive application apparatus of claim 1, further comprising:

an image obtainer configured to obtain an image of the liquid adhesive applied to the trial application stage in the trial application; and a suction controller configured to make the suction unit carry out the suction operation of the applied liquid adhesive at or after a time when the image obtainer obtains the image of the applied liquid adhesive.

5. The adhesive application apparatus of claim 1, further comprising:

an image obtainer configured to obtain an image of the liquid adhesive applied to the trial application stage in the trial application;

a quantity tester configured to determine whether or not the quantity of the applied liquid adhesive is appropriate according to the image obtained by the image obtainer and reference quantity data related to the liquid adhesive; and a suction controller configured to make the suction unit carry out the suction operation of the applied liquid adhesive if the quantity tester determines that the quantity of the applied liquid adhesive is appropriate.

6. The adhesive application apparatus of claim 1, further comprising:

an image obtainer configured to obtain an image of the liquid adhesive applied to the trial application stage in the trial application;

a quantity tester configured to determine whether or not the quantity of the applied liquid adhesive is appropriate according to the image obtained by the image obtainer and reference quantity data related to the liquid adhesive;

a quantity calculator configured to calculate, if the quantity tester determines that the quantity of the applied liquid adhesive is inappropriate, a quantity of the liquid adhesive to be applied according to data related to the determination made by the quantity tester;

an application controller configured to make the application unit carry out the trial application of the liquid adhesive according to the quantity calculated by the quantity calculator; and a suction controller configured to make the suction unit carry out the suction operation of the applied liquid adhesive if the quantity tester determines that the quantity of the applied liquid adhesive is appropriate.

7. An adhesive application apparatus for applying a liquid adhesive to an object, comprising:

a regular application stage against which the object is placed for a regular application of the liquid adhesive to the object;

a trial application stage to which a trial application of the liquid adhesive is carried out;

an application unit relatively movable with respect to the regular application stage and trial application stage to carry out the regular application and trial application of the liquid adhesive;

a suction unit carrying out a suction operation of the liquid adhesive used in the trial application by applying a suction force to clear the liquid adhesive used in the trial application from the trial application stage; and a porous adsorptive pad provided with the trial application stage and including a porous liquid-repellant part comprising a fluorine coating and a porous non-liquid-repellant part, wherein the non-liquid-repellant part is constructed so as to allow a droplet of the liquid adhesive to pass through from a front side to a backside of the non-liquid-repellant part even in absence of the suction operation, and wherein the liquid-repellant part comprising the fluorine coating is constructed so as to not pass the droplet of the liquid adhesive from a front side through to a backside of the liquid-repellant part comprising the fluorine coating until the suction operation is performed.

8. An adhesive application apparatus for applying a liquid adhesive to an object, comprising:

a regular application stage against which the object is placed for a regular application of the liquid adhesive to the object;

a trial application stage to which a trial application of the liquid adhesive carried out;

an application unit relatively movable with respect to the regular application stage and trial application stage to carry out the regular application and trial application of the liquid adhesive;

a suction unit that applies a suction force to clear the liquid adhesive used in the trial application from the trial application stage; and a porous adsorptive pad provided with the trial application stage and including a porous liquid-repellant part comprising a fluorine coating and a porous non-liquid-repellant part, wherein the non-liquid-repellant part is constructed so as to allow a droplet of the liquid adhesive to pass therethrough even in absence of the suction force, and wherein the liquid-repellant part comprising the fluorine coating is constructed so as to resist passing the droplet from a front side through to a backside until the suction force is applied, and wherein the liquid-repellant part comprising the fluorine coating is adapted so that the droplet applied to the liquid-repellant part comprising the fluorine coating attains a ball shape in absence of the suction force in which a cross section diameter of the applied ball shape droplet along a maximum diameter direction exceeds a cross section diameter of the applied ball shape droplet at a surface plane of the pad.

* * * * *